US005327939A

United States Patent [19]

Burgess

[11] Patent Number: 5,327,939

[45] Date of Patent: Jul. 12, 1994

[54] LOOM TAKE-UP WITH WEDGE DOFFER

[76] Inventor: F. Eddie Burgess, 135 Hester Store Rd., Easley, S.C. 29640

[21] Appl. No.: 57,153

[22] Filed: May 5, 1993

[51] Int. Cl.[5] ..... D03D 49/20

[52] U.S. Cl. ..... 139/1 R; 242/533; 242/541.2; 139/308; 414/911

[58] Field of Search ..... 294/96; 242/66; 139/1 R, 291 R, 308; 444/911, 24.5

[56] References Cited

U.S. PATENT DOCUMENTS

| | | | |
|---|---|---|---|
| 1,833,185 | 11/1931 | Sieg . | |
| 1,904,255 | 4/1933 | Seeley | 242/66 |
| 3,406,925 | 10/1968 | Waterhouse . | |
| 3,990,648 | 11/1976 | Justus et al. . | |
| 4,023,690 | 5/1977 | Goode | 414/911 X |
| 4,023,693 | 5/1977 | Priefert | 414/911 X |
| 4,090,616 | 5/1978 | Runyan et al. | 414/911 X |
| 4,146,190 | 3/1979 | Bond et al. . | |
| 4,203,563 | 5/1980 | Alexander, III et al. . | |
| 4,216,804 | 8/1980 | Alexander, III et al. . | |
| 4,573,845 | 3/1986 | Carpenter | 414/24.5 |
| 5,238,352 | 8/1993 | Abe et al. | 414/911 X |

*Primary Examiner*—Andrew M. Falik
*Attorney, Agent, or Firm*—Cort Flint

[57] ABSTRACT

A doffing apparatus for use with a loom take-up which includes a pair of drive spaced and aligned drive rolls supporting a cloth roll therebetween. The drive rolls act to drive the cloth roll so as to wind cloth delivered from the loom thereon. The doffing apparatus includes a pair of pivotally mounted support arms carrying a wedge. A support rod connects the wedge means with this support arm for pivotal and longitudinal movement relative thereto. In operation, the doffing apparatus is located relative to the drive roll and the cloth roll and the wedge means is positioned in the nip between these rolls so that continued rotation thereof draws the wedge means in between the rolls in a manner to lift the cloth roll from the driven roll.

13 Claims, 4 Drawing Sheets

LOOM TAKE-UP WITH WEDGE DOFFER

BACKGROUND OF THE INVENTION

The instant invention is directed to doffing apparatus for use with a loom take-up of the type having a pair of spaced drive rolls which support and drive the cloth roll during take-up.

Cloth rolls when employed with take-up apparatus of this type are usually positioned in front of the loom. The fabric usually passes beneath a work place platform and over an inspection frame prior to being wrapped onto the take up as a cloth roll. Because the take-up apparatus is spaced from the loom and is not constricted for space, it is possible to build the cloth roll to be very large, somewhere in the order of 2000 lbs, before doffing is necessary. Due to this large weight, it is very difficult, if not impossible, for a single operator to doff the cloth roll. Accordingly, a mechanical doffing apparatus becomes most desirable.

Several attempts have been made in the past to provide a satisfactory doffing apparatus for a loom take-up mechanism. The doffing apparatus must be inexpensive to construct, it must be sturdy in order to work with the heavy weight of the cloth roll and it must not delay production when in use. U.S. Pat. No. 4,203,563 is directed to one attempt to provide a doffing apparatus capable of meeting this criteria. Here a doffing roll C is carried by arms 16 which are motivated by gears A and D. In order to doff cloth roll 12, the take-up drive must be reversed and roll C elevated to engage gears A and D which then move roll C across the drive roll 10 to doff the cloth roll. This doffing device is both expensive due to the use of gears and the structural strength necessary for the arms and doff roll. Also, production is interrupted during the reversal operation of the take-up apparatus.

The instant apparatus has as its object to provide doffing apparatus which satisfies the requirements set forth above.

Another object of the invention is to provide doffing apparatus which is easy and convenient to use.

Another object of the invention is to provide doffing apparatus which is light weight.

Another object of the invention is to provide doffing apparatus which is reliable.

Another object of the invention is to provide a doffing apparatus which does not interrupt the operation of the take-up mechanism.

SUMMARY OF THE INVENTION

A doffing apparatus for use with a loom take up which includes a pair of spaced and aligned drive rolls supporting a cloth roll therebetween. The drive rolls act to rotate the cloth roll to wind the cloth delivered from the loom thereon. The doffing apparatus includes a pair of support arms which are pivotally mounted at one end on opposed ends of one of the pair of drive rolls. A shaft is pivotally arranged to be parallel with and spaced from the one drive roll. A second shaft interconnects the support arms.

A wedge is mounted on the shaft in a non-pivotal manner. The wedge comprises a plurality of individual wedge members which are longitudinally moveable along the shaft to function independently of each other. The wedge members may also function in unison. In operation, the doffing apparatus is located relative to the drive roll and the cloth roll. The wedge means is positioned in the nip between the rolls so that rotation thereof draws the wedge means between the rolls in a manner to lift the cloth roll from the drive roll.

The drive rolls support the cloth roll and are driven in a first direction to rotate the cloth roll in a second direction to wind the cloth there about. As stated above, the wedge members may function independently or as a unit to doff the cloth roll. Normally there are three wedge members. Each of the wedge members include a sharp edge. Doffing is carried out by positioning the sharp edge of the wedge members between the cloth roll and one of the drive rolls. Continued rotation of the one drive roll in the first direction draws or walks the wedge means in between the drive roll and the cloth roll to lift the cloth roll and cause it to be doffed.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
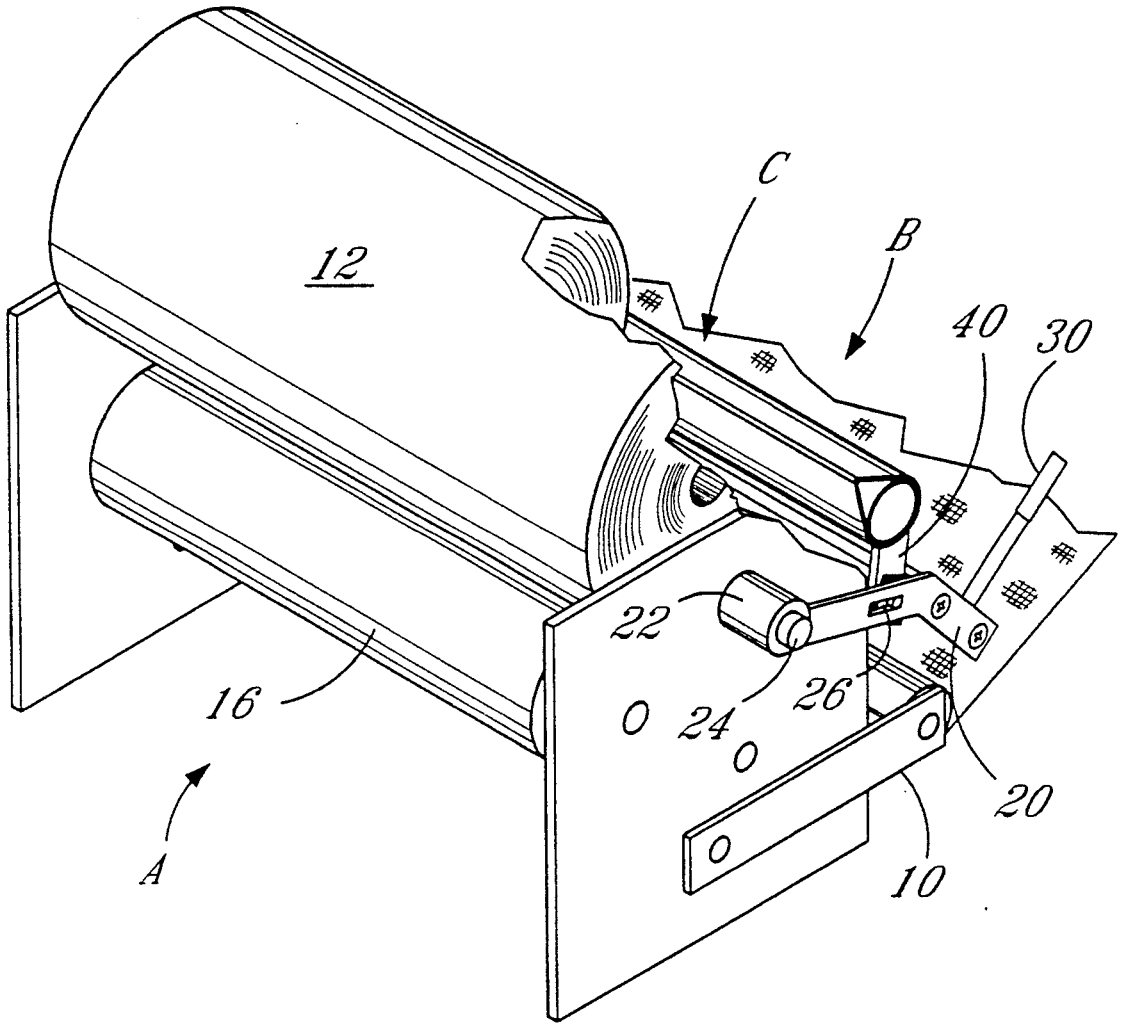
FIG. 1 is perspective view illustrating the doffing apparatus according to the invention positioned on a loom take-up apparatus.
Figure 2:
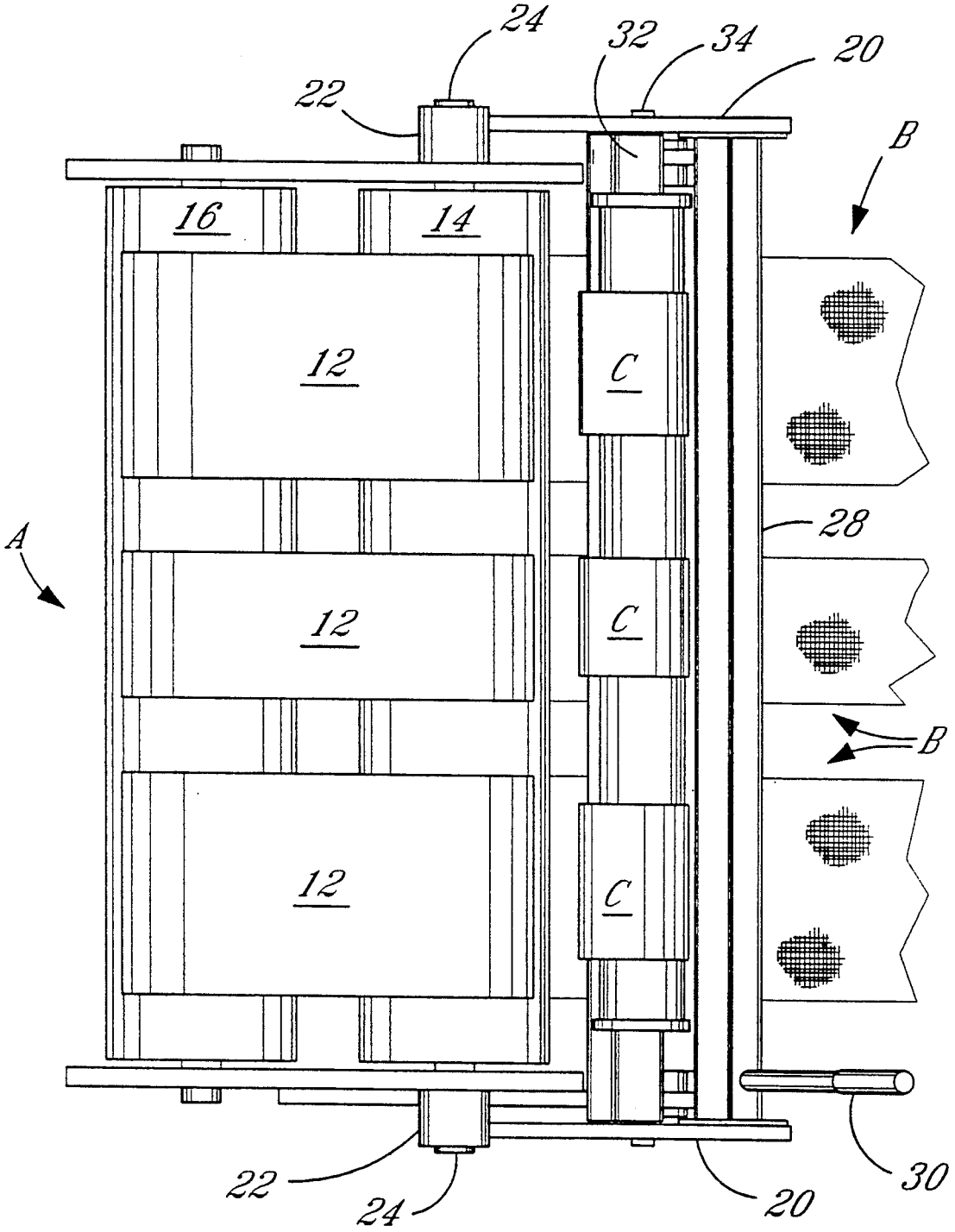
FIG. 2 is a top view showing the doffing apparatus of the invention.
Figure 3:
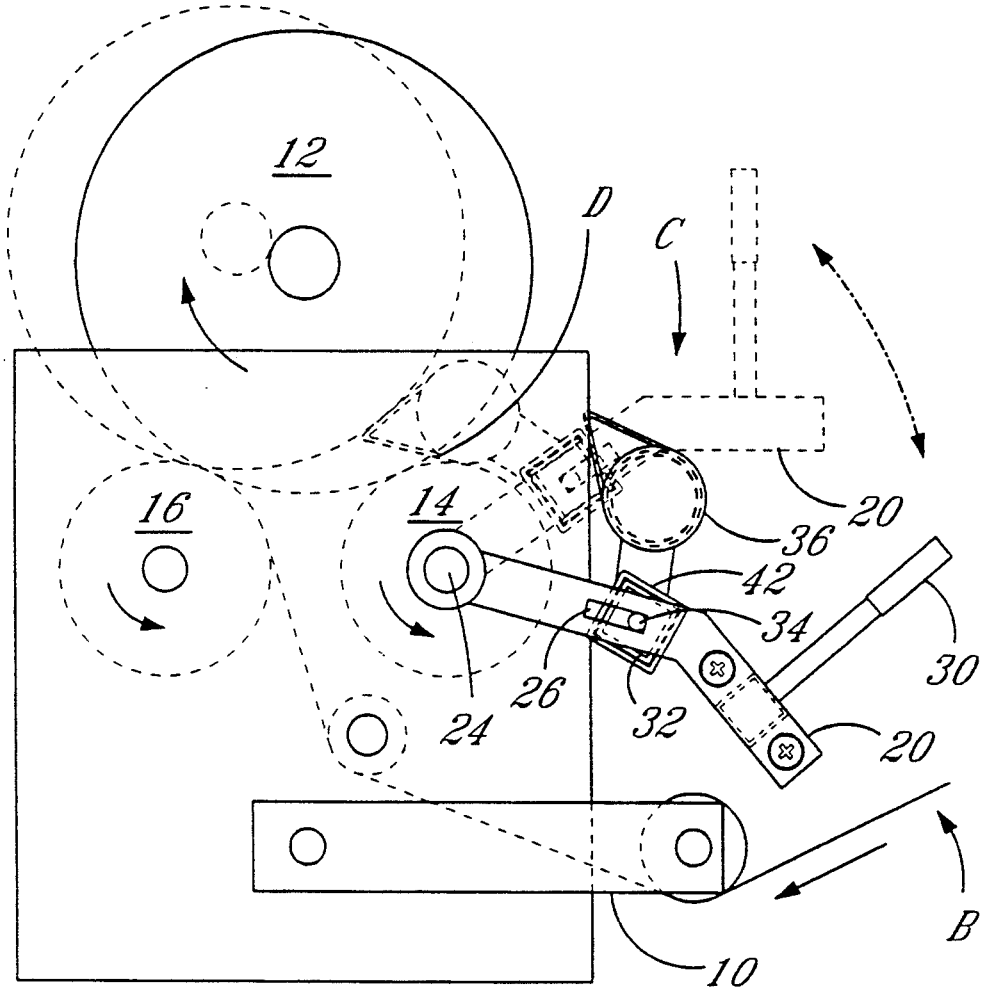
FIG. 3 is a side view of the invention showing the doffing apparatus in the doffed positions.
Figure 3A:
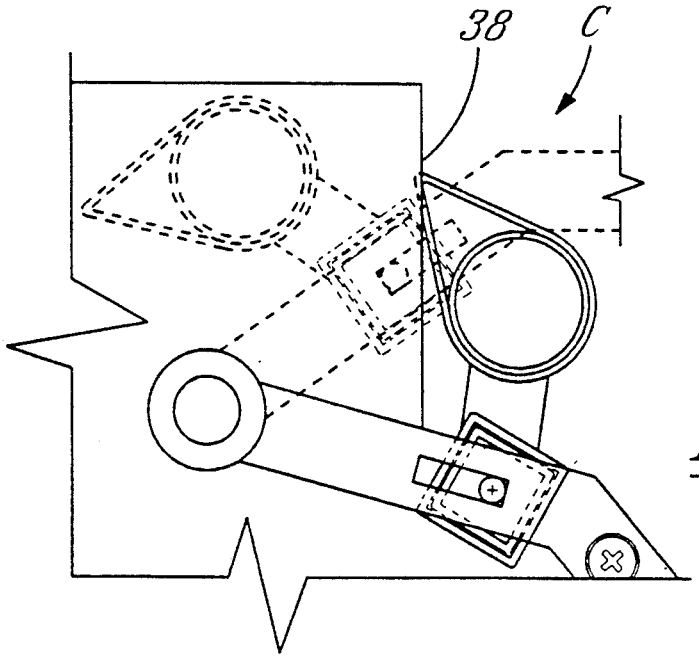
FIG. 3*a* is an exploded side view showing the wedge structure in more detail.

Referring now to FIGS. 1–3 of the drawings, a loom take-up A, which may be of the type disclosed in U.S. Pat. No. 4,146,190 or any other known and similar type take-up mechanism, is located in a position spaced from the front of a loom, not shown. The fabric or fabrics B are delivered from the loom to pass over dancer roll 10 from which it passes to a single cloth roll 12 or a plurality of cloth rolls 12. The cloth roll or rolls rest on a pair of spaced and parallel drive rolls 14 and 16 which are driven by any known drive motor D through chain 50 in the direction of the arrows shown in FIGS. 1 and 3. Cloth rolls 12 rest on the surface of drive rolls 14 and 16 and are rotated in the direction opposite that of drive rolls. There are compensating means connected with dancer roll 10 which control the RPM's of drive rolls 14 and 16 in response with the tension in the fabric delivered from the loom. This is a common arrangement and forms no part of the instant invention. As the cloth is wound on roll 12 the diameter of the roll increases until it is necessary to doff a fully built roll 12 and replace it with another roll.

The doffing apparatus of the instant invention includes a pair of support arms 20 which are pivotally mounted with shaft 24 of drive roll 16 by a sleeve fitting 22 which is formed on one end of each support arm 20. At an intermediate point of each of the support arms 26 there is provided a slot 26. Slots 26 extend for between one and four inches longitudinally of support arms 20. A connecting rod 28 is secured between and adjacent the opposite ends of support arms 20. An operating lever 30 is secured with connecting rod 28. A square support rod 32 is arranged between and secured with arms 20 by slots 26. Circular pins or extensions 34 are provided at each end of support rod 32 and are received in slots 26 to pivotally mount support rod 32 and to also allow for longitudinal movement thereof along slot 26.

A wedging member C is supported by rod 32. The wedging member includes an enlarged rear portion 36 and a substantial sharp forward edge portion 38. The body portion of wedge C diverges outwardly from edge 38 to rear portion 36 in a V fashion. Wedge C may be constructed to extend substantially over the full length of rod 32 or it may be constructed to extend over only between 30 percent and 70 percent of the length of rod 32. The latter construction allows wedge C to be longitudinally positioned relative to rod 32 so as to engage cloth rolls at selected locations across drive rolls 14 and 16.

A extension 40 connects with rear portion 36 of the wedge C and also with a hollow square shaped tube 42. Tube 42 which is of a length slightly less or substantially equal that of wedge C is configured to fit loosely about square support rod 32 so that wedge C is allowed a degree of movement and may be adjusted longitudinally relative to support rod 32 without being able to rotate about the support rod. Wedge C to include extension 40 is constructed to extend radially of support rod 32 to prevent rotation of rod 32 by engagement of the wedge with connecting rod 28 or drive roll 14.

During normal operation of the loom the doffing apparatus remains in a position of rest. In this position wedge C rests against connecting rod 28 and pins 24 of support rod 32 rests against the outermost ends of slots 26. When it is necessary to doff a fully built cloth roll 12, handle 30 raises wedge C toward cloth roll 12. Wedge C pivots about pins 34 in slots 26 until edge 38 engages with the outer surface of roll 14. Support arms 20 are further rotated to position edge 38 in nip D between cloth roll 12 and drive roll 14. As these rolls continue to rotate they engage with the outer surfaces of wedge C and pull it between them in a manner which separates progressively cloth roll 12 from drive roll 14. As wedge C moves into nip D, the radius between the axis of drive roll 14 and the axis of pins 34 and wedge C increases due to the configuration of the wedge. Slots 26 allow support shaft 32 to move longitudinally of support arms 20 as wedge C is walked into position between the rolls. When wedge C moves slightly past the position shown in broken lines in FIG. 3, the cloth roll has been sufficiently raised to be doffed. At no time during doffing is the operation loom or the take-up interrupted.

Figure 1A:
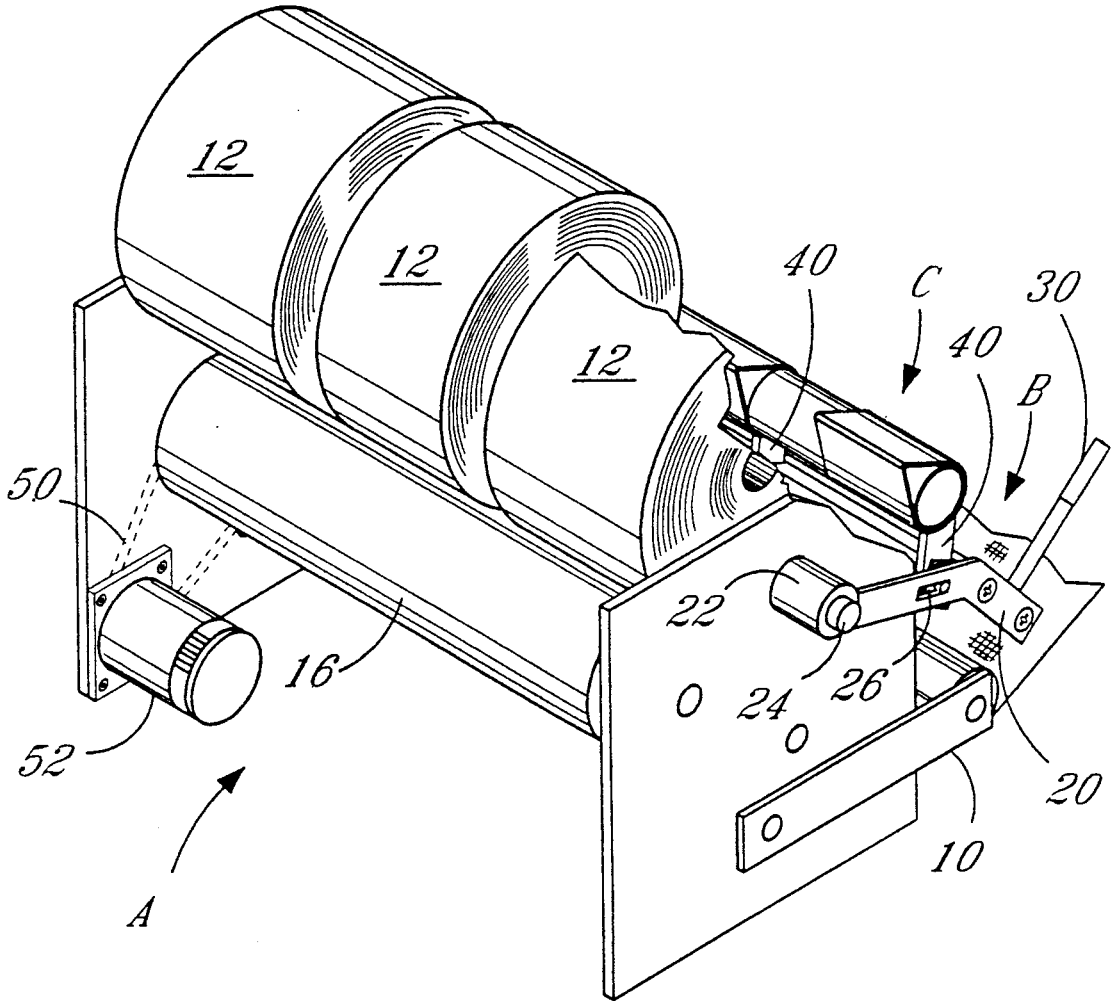
FIG. 1A is a perspective view of an alternative arrangement according to the invention in which the wedge member comprises a plurality of laterally spaced elements.

In the alternative arrangement shown in FIG. 1A, it may be desirable to construct wedge C as a plurality of individual wedges extending across support rod 32 in a spaced manner. Each wedge C is supported by extension 40 mounted with individual shaped tubes 42. In the alternative arrangement, each of wedges C is longitudinally movable along rod 32 so that they may function adjacent to or spaced from each other or certain ones may be moved to an inoperative position. There may be up to three individual wedges C arranged on rod 32.

It is noted that when the loom is weaving a plurality of narrow fabrics there are as many as five individual cloth rolls on which cloth is wound. In this circumstance, it may become desirable to doff individually the cloth rolls. In this event, those wedge members C not doffing are simply moved to an inoperative position longitudinally of rod 32 while the other wedge members are moved to doff the selected of the cloth rolls. FIGS. 1A and 2 are illustrative of plural cloth rolls and plural doffing wedges.

While the doffing apparatus of the invention has been described as being hand operated, the structural arrangement disclosed lends itself very well for use with an automatic doffing motion. In this arrangement, a solenoid or piston would be connected with arms 20. Sensing means associated with the take up would sense when a cloth roll 12 is in need of begin doffed and would send a signal to activate the solenoid or piston to move arms 20 to position wedge C in position to doff. The doffing action would then be carried out as earlier described.

While a preferred embodiment of the invention has been described using specific terms, such description is for illustrative purposes only, and it is to be understood that changes and variations may be made without departing from the spirit or scope of the following claims.

What is claimed is:

1. Doffing and take-up apparatus for a loom including a pair of driven spaced and aligned drive rolls supporting at least one cloth roll therebetween, said drive rolls act to rotate the cloth roll so as to wind cloth delivered from said loom thereon, said apparatus comprising:

a pair of support arms pivotally carried on opposed ends of one of said pair of drive rolls;

a support rod means mounted with and interconnecting said support arms, said rod being spaced from said one drive roll;

a wedge carried by said support rod in a non-rotating manner, said wedge being capable of longitudinal movement relative said support rod whereby;

with said wedge located relative to said one drive roll and said cloth roll, an edge of said wedge is positioned in the nip between said cloth roll and said one drive roll so that continued rotation of said one drive roll and said cloth roll draws said wedge between said one drive roll and said cloth roll lifting and doffing said cloth roll from said take up.

2. The device of claim 1 wherein said wedge comprises a plurality of longitudinally spaced wedge members.

3. The device of claim 2 wherein said support rod is shaped and said wedge members include shaped means interconnecting with said support rod in a non-rotating manner.

4. The device of claim 2 wherein said support rod is arranged to allow said individual wedge members to function independently of each other.

5. The device of claim 1 wherein said support arms are provided with a longitudinal slot which mounts said support rod for both rotational movement and longitudinal movement relative to said support arms.

6. A take-up and doffing apparatus for building and removing at least one cloth roll, said apparatus including spaced and aligned drive rolls for driving and supporting said cloth roll, driving means driving said drive rolls in a first direction to drivingly rotate said cloth roll in a second direction to build said roll by winding cloth thereon,:

support structure carrying support arms having slots, a rod carried by said slots of said support arms for longitudinal and rotating movement relative to said support arm, a wedge carried by said rod, said support arms and said rod acting to position an edge of said wedge between said cloth roll and one of said drive rolls whereby;

continued rotation of said one drive roll in said first direction draws said wedge in between said one drive roll and said cloth roll causing said wedge to lift and doff said cloth roll apparatus.

7. The device of claim 6 wherein means connect said wedge with said rod in a non-pivoting manner.

8. The device of claim 6 wherein said take up and doffing apparatus carries a plurality of independent cloth rolls and said wedge comprises a plurality of wedge members arranged on said rod for longitudinal movement thereof, whereby said wedge members may be positioned to function independently and as a unit.

9. The device of claim 8 wherein there are three wedge members and up to five cloth rolls.

10. The device of claim 8 wherein said edge of said wedge means is sharp.

11. The device of claim 8 wherein said wedge members include connecting means, said connecting means connect said wedge members longitudinally over a portion of said rod in a non-pivoting manner whereby said wedge members may be moved longitudinally of said rod to be positioned to doff selected cloth rolls individually and in combination.

12. A method of doffing a cloth roll from a loom take-up which includes a pair of spaced and aligned drive rolls which support and rotate said cloth roll, said take-up including a doffing wedge, said method including:

pivoting said wedge about an axis of rotation to position an edge thereof in the nip between one of said drive rolls and said cloth roll;

continuing to rotate said drive rolls and said cloth roll so that said wedge is drawn between said cloth roll and said drive roll;

moving said axis of rotation transversely of its longitudinal axis during drawings of said wedge between said cloth roll and said drive roll to allow for a change in radius between said wedge and said drive roll; and doffing said cloth roll.

13. The method of claim 12 including providing a plurality of independent cloth rolls be supported and rotated by said drive rolls and providing a plurality of selectively operative doffing wedges to selectively doff said cloth rolls.

* * * * *